US007373998B2

(12) United States Patent
Cariveau et al.

(10) Patent No.: US 7,373,998 B2
(45) Date of Patent: May 20, 2008

(54) CUTTING ELEMENT WITH IMPROVED CUTTER TO BLADE TRANSITION

(75) Inventors: Peter Thomas Cariveau, Spring, TX (US); Thomas B. White, Pine, CO (US)

(73) Assignee: Smith International, Inc., Houston, TX (US)

( * ) Notice: Subject to any disclaimer, the term of this patent is extended or adjusted under 35 U.S.C. 154(b) by 191 days.

(21) Appl. No.: 11/094,330

(22) Filed: Mar. 29, 2005

(65) Prior Publication Data

US 2005/0241861 A1 Nov. 3, 2005

Related U.S. Application Data

(60) Provisional application No. 60/558,757, filed on Apr. 1, 2004.

(51) Int. Cl.
*E21B 10/573* (2006.01)

(52) U.S. Cl. ..... 175/432; 175/428

(58) Field of Classification Search ..... 175/428, 175/432, 426

See application file for complete search history.

(56) References Cited

U.S. PATENT DOCUMENTS

| | | | | |
|---|---|---|---|---|
| 4,679,639 | A * | 7/1987 | Barr et al. | 175/432 |
| 4,749,052 | A * | 6/1988 | Dennis | 175/432 |
| 5,115,873 | A * | 5/1992 | Pastusek | 175/65 |
| 5,301,762 | A * | 4/1994 | Besson | 175/379 |
| 5,383,527 | A * | 1/1995 | Azar | 175/431 |
| 5,558,170 | A | 9/1996 | Thigpen et al. | |
| 6,009,962 | A * | 1/2000 | Beaton | 175/426 |
| 6,302,223 | B1 | 10/2001 | Sinor | |
| 6,302,224 | B1 | 10/2001 | Sherwood | |
| 6,604,588 | B2 | 8/2003 | Eyre et al. | |
| 2003/0062201 | A1 | 4/2003 | Eyre et al. | |

FOREIGN PATENT DOCUMENTS

EP 0 852 283 A3 9/1999

OTHER PUBLICATIONS

United Kingdom Combined Search and Examination Report; Appl. No. GB0506561.0; dated May 12, 2005; 5 pages.
United Kingdom Examination Report issued on corresponding Appl. No. GB0506561.0; dated Aug. 11, 2006; 1 page.
Official Action issued on corresponding Canadian Patent Appl. No. 2,503,430; Dated Apr. 10, 2006; 3 pages.
Official Action issued in corresponding Canadian Application No. 2,503,430; Dated Apr. 25, 2007; 2 pages.

* cited by examiner

*Primary Examiner*—Jennifer H Gay
*Assistant Examiner*—David Andrews
(74) *Attorney, Agent, or Firm*—Osha Liang LLP

(57) ABSTRACT

Cutting elements having a slanted top surface for an improved cutter to blade transition, the slanted top surface being integratable into a receiving pocket of a bit blade such that the slanted top surface and the perimeter of the receiving pocket are relatively contiguous when the slanted cutter is mounted within the receiving pocket. Also, a bit with slanted cutters as well as a method of manufacturing a bit having slanted cutters.

22 Claims, 4 Drawing Sheets

CUTTING ELEMENT WITH IMPROVED CUTTER TO BLADE TRANSITION

CROSS-REFERENCE TO RELATED APPLICATIONS

The present invention claims the benefit of U.S. Provisional Patent Application No. 60/558,757 entitled "Cutting Element with Improved Cutter to Blade Transition," filed on Apr. 1, 2004 by Peter Thomas Cariveau, hereby incorporated herein by reference.

BACKGROUND OF THE INVENTION

1. Field of the Invention

The invention relates generally to improvements in drag bit cutter geometries and the attachment of such cutters to a bit blade.

2. Background Art

Oil wells and gas wells are typically created by a process of rotary drilling. In conventional rotary drilling a drill bit is mounted on the end of a drill string. At the surface a rotary drive turns the string, including the bit at the bottom of the hole, while a drilling fluid, or "mud," is pumped through the drill string.

When the bit wears out or breaks during drilling, it must be brought up out of the hole in a process called "tripping-out." During this process, a heavy hoist pulls the drillstring out of the hole and rig workers disconnect the components thereof in stages. Tripping-out of the borehole is a time-consuming endeavor. One trip can require days, and may significantly impact the drilling budget, as no drilling progress occurs during this period. To resume drilling the entire process must be reversed. Accordingly a bit's durability and drilling efficiency are very important, to minimize round trips for bit replacement during drilling, and to maximize drilling progress between trips.

The teeth of a drill bit crush or cut rock. One type of bit is a "drag" bit, where the entire bit rotates as a single unit. The body of the bit holds fixed teeth, or "cutters," which are typically made of an extremely hard material, such as tungsten carbide, and are often coated with even harder substances, such as polycrystalline diamond compact (PDC). The body of the bit may be steel, or may be a matrix of a harder material such as tungsten carbide.

All drill bit teeth can be expected to fail eventually. Typically, PDC-type drill bit teeth have three common failure modes. The first failure mode involves inward abrasive wear of the cutting face in which a side of the cutter's hardened face is gradually eroded inward, so that a portion of the tooth's volume is gradually removed.

A second failure mode involves fracture of the cutting face or the cutting teeth. Because the force on the tooth's face is typically not evenly distributed, it is possible for failure in shear to occur (where part of the face, and possibly part of the body behind it, breaks away from the rest of the tooth). This is a particularly damaging failure mode, as the separated tooth fragment is likely to be encountered by remaining cutting teeth. Being much harder than the surrounding formation, the tooth fragment can fracture one or more other teeth. There is also a chance of a cascading effect where shards from one or more broken teeth cause further tooth breakage which continues to propagate to other teeth of the bit.

A final failure mode is a "prying out" failure, where all or most of a single tooth is removed from its retaining socket.

With this type of failure, the single mass of hardened material has an even greater chance of damaging other teeth on the bit.

Accordingly, one approach to maximizing drilling efficiency is by increasing the durability and cutting efficiency of individual cutters, within the constraints of known cutter failure modes. Typically, this will involve balancing increased tooth clearance and exposure against increased susceptibility to the failure modes previously discussed.

Bent and bullet-type teeth represent two variations of such an approach. Angled or bent teeth, such as disclosed in U.S. Pat. No. 6,302,224, issued to Sherwood, hereby incorporated herein by reference, typically have two nonparallel axes. Often, bent drill bit teeth have a greater volume embedded in the bit body, and a lesser volume protruding therefrom. Such teeth can have a cutting face bent at an angle of up to 90 degrees relative to the shank. Although a greater volume of tooth embedded within the bit will reduce the likelihood of a prying out failure and results in an increased clearance, the bent tooth design is susceptible to increased fracture rates at the vertex of the bend. Furthermore, the pockets and other tooth retention mechanisms are relatively complex compared to a typical straightforward cylindrical cutter design. Additionally, because so much of a bent tooth is required to be embedded within the bit body, the number of teeth that may be located in a given area may be limited by the size of the bit body.

Bullet-type drill bit teeth as disclosed in U.S. Pat. No. 5,558,170 issued to Thigpen et al., hereby incorporated herein by reference, are generally cylindrical, with a hemispherical back end for seating in a correspondingly milled pocket. Typically the body of a bullet tooth comprises a hardened material and the face includes a flat circular body coated with a superhard material such as a polycrystalline diamond compact ("PDC") or tungsten carbide. The corresponding pocket of a bullet-type tooth can include sidewalls extending upwards to partially enclose the top of the tooth to resist prying-out of the tooth. However, such partial enclosure of the top of the tooth may affect tooth clearance and the hemispherical back end may not permit as strong a braze as may be achieved with typical cylindrical cutter designs. Cylindrical designs have a flat back end that is more easily brazed in a corresponding receiving pocket.

In drilling through softer formations, it is advantageous to maximize the depth of cutter penetration. This is achieved by maximizing distribution of the applied drilling load on the cutters, and avoiding distribution of such load to surfaces of the bit that are less capable of efficiently shearing the formation. Accordingly, there exists a need for a cutter design having an increased exposure for greater cutting efficiency, an increased clearance to minimize contact of the formation with the bit body, and with decreased susceptibility to typical cutter failure modes.

SUMMARY OF THE INVENTION

In one embodiment, a slanted cutter configuration is disclosed, having a slanted top side that improves the transition between the cutter and the blade in which it is disposed.

In one embodiment, a drill bit with slanted cutters is disclosed. Such a configuration is more effective for drilling softer formations due to an increased exposure of the cutters and increased braze strength compared to bullet-type cutters.

In one embodiment, a method of manufacturing a drill bit is disclosed, in which receiving pockets are created in a bit body and configured to accommodate slanted cutters.

Other aspects and advantages of the invention will be apparent from the following description and the appended claims.

DETAILED DESCRIPTION

Figure 1:
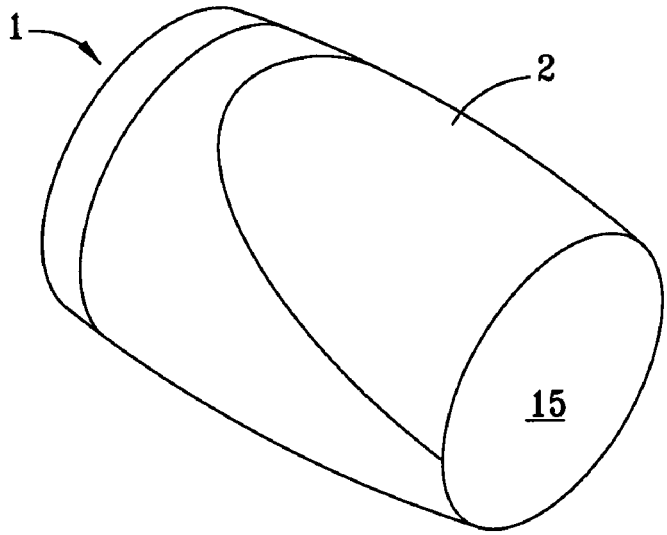
FIG. 1 shows a slanted cutter, in accordance with an embodiment of the present invention.
Figure 2:
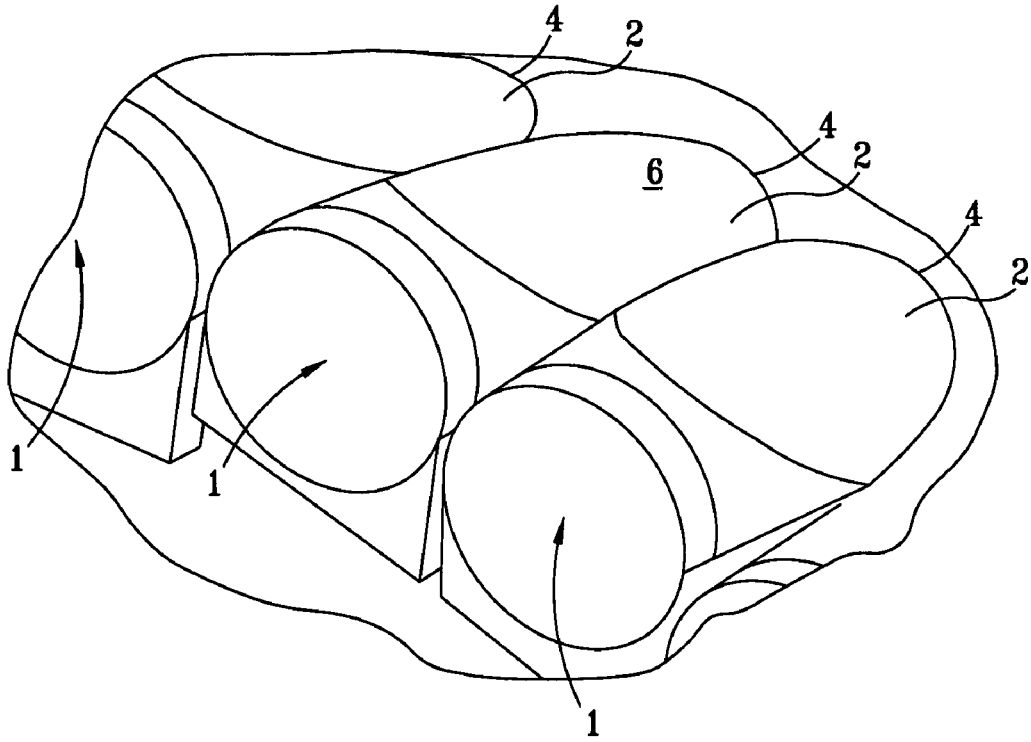
FIG. 2 shows a plurality of slanted cutters disposed on a blade of a drill bit, in accordance with an embodiment of the present invention.

FIGS. 1 and 2 show improved cutter geometry according to an embodiment of the invention. This geometry maximizes cutter clearance and lessens the amount of formation contacting the bit body between the cutters. Less contact between the formation and bit body results in increased longevity for a drill bit. This is achieved by using a shape for a cutting element in which a generally cylindrical cutting element has a slanted top 2 for blending into the surrounding cutter blade 6. Such a configuration will be hereinafter referred to as a slanted cutter 1.

Top and bottom surfaces of cutters disclosed herein are defined with respect to the drill bit body in which they are or will be mounted, with the bottom surface being that which is closest to, or embedded in, the blade 6, and the top being that surface which is closest to a predicted location of the formation in which the drill bit is disposed. The back end 15 of the slanted cutter 1 will generally be disposed within a receiving pocket 4.

In FIG. 2, a plurality of slanted cutters 1 is visible, each having a slanted top or profile 2. The slanted profile 2 of each slanted cutter 1 blends into the surrounding blade 6 of the bit body by tapering towards the perimeter of the receiving pocket 4. The geometric configuration of the slanted cutter 1 may vary with varying configurations of bit bodies, the blade 6 disposed thereupon, and the receiving pockets 4 disposed in such blades 6. Slanted top 2 surface may be created at the time cutter 1 is manufactured or may be fabricated in a pre-existing cutter. Therefore, a typical cylindrical-type cutter may be machined to include a slanted top profile 2. Furthermore, slanted cutters may be milled or otherwise adjusted to match a desired configuration of blades 6 or receiving pockets 4. Slanted cutters may be milled such that the angle of slanted profile 2 with respect to back end 15 is from 45° to 85° and from 5° to 45° with respect to cutter face 10 (shown in FIG. 6). Because slanted profile 2 may be a linear, planar, or curved surface, it should be understood that the angle of inclination between profile 2 and back end 15 or face 10 will be an average angle of inclination for curved surfaces.

Figure 3:
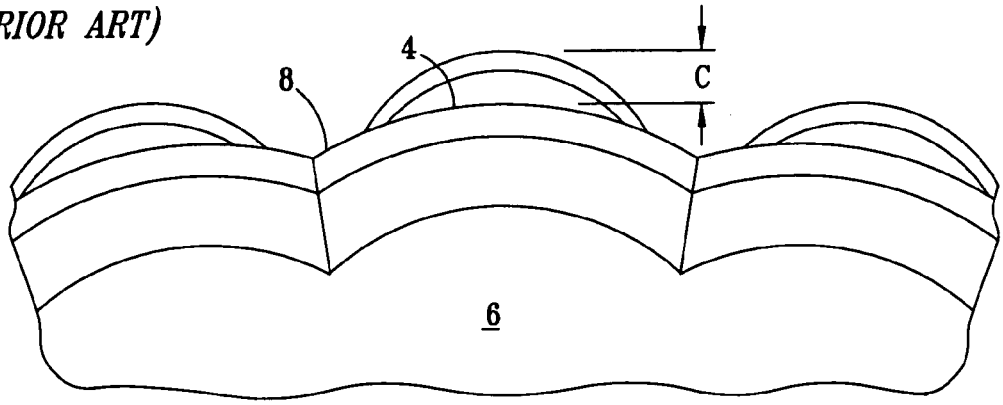
FIG. 3 (PRIOR ART)
FIG. 3 is a trailing view of a prior-art configuration of cylindrical cutters disposed in a drill bit blade.
Figure 4:
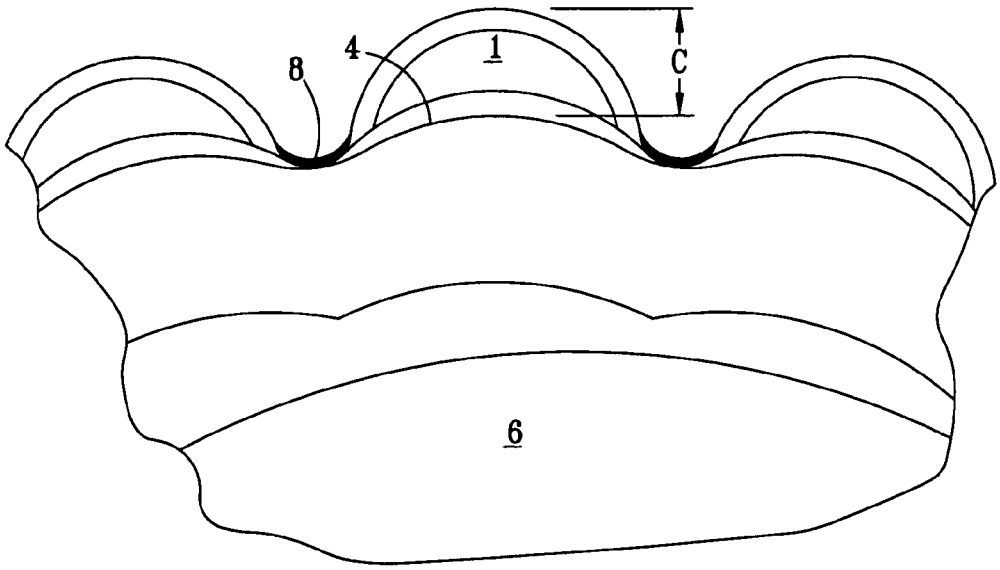
FIG. 4 is a trailing view of a plurality of slanted cutters disposed on a blade of a drill bit in accordance with an embodiment of the present invention.

Slanted cutters 1 according to various embodiments of the invention have a number of advantages, particularly in drilling softer formations. As shown in trailing-view FIGS. 3 and 4, a first advantage includes an increased clearance C between the top of the cutter and the portion of the blade 6 that forms the receiving pocket 4. The increase in clearance C from FIG. 3 to FIG. 4 is a result of the decreased height to which the blade 6 and hardfacing 8 must extend in order to properly seat and retain the slanted cutter 1, and protect the region of blade 6 between cutters. The slanted top profile 2 of cutter 1 allows the front of cutter 1, including the cutter face 10 (shown in FIG. 6), to extend an increased distance from the bit body while the majority of the cutter body is be clear of the formation to be cut. As a result, the cutter face 10 is able to protrude farther away from blade 6 and into the formation without a significant increase in contact between the formation and the cutter body or a portion of the blade 6 (e.g., the area of bit body forming receiving pocket 4) extending over cutter 1. Such a configuration increases penetration into the formation at the cutter face 10 and enables a reduction in drag and friction forces between cutter blade 6 and the formation.

Figure 5:
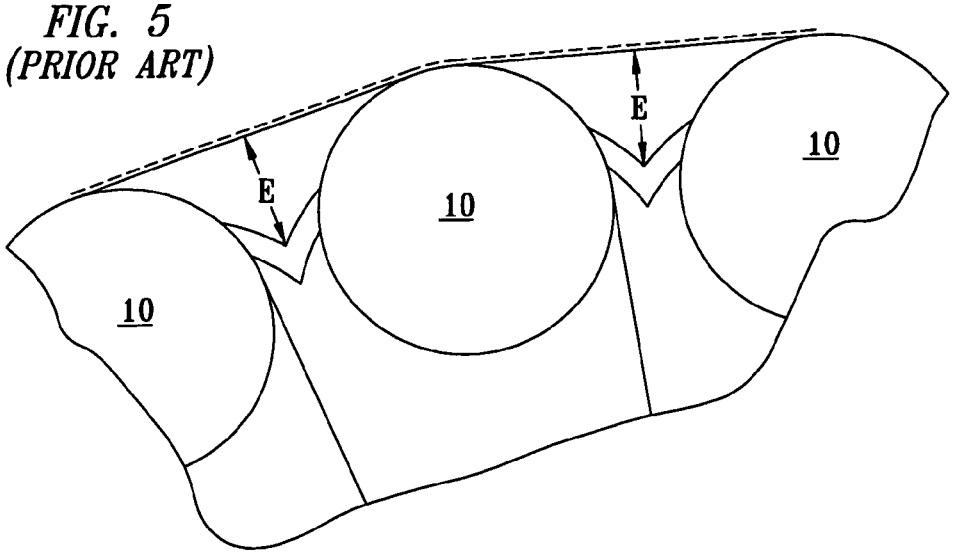
FIG. 5 (PRIOR ART)
FIG. 5 is a frontal view of a plurality of prior-art cutters disposed in a drill bit blade.
Figure 6:
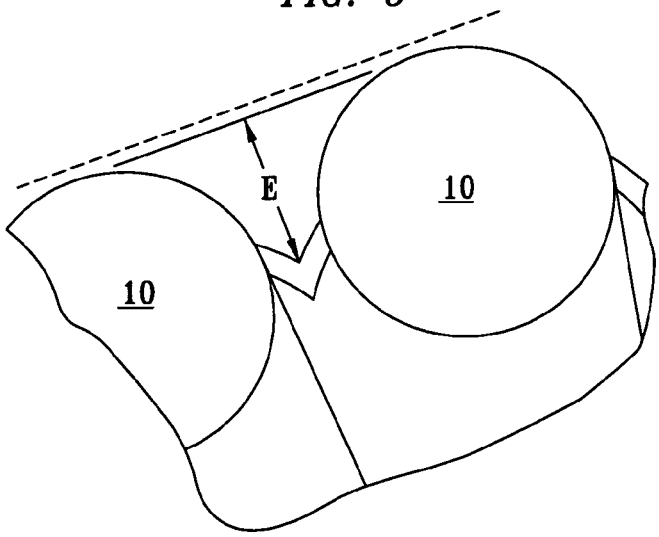
FIG. 6 is a frontal view of a plurality of slanted cutters disposed in a drill bit blade in accordance with an embodiment of the present invention.

Referring to FIGS. 5 and 6, slanted cutters 1 (FIG. 6) will also have an increased cutter exposure when compared to traditional cutters (FIG. 5). As shown in FIGS. 5 and 6, cutter exposure E relates to the portion of the cutter face 10 that extends outward beyond the bit blade 6 at the cutting face. An increase in exposure E will result in increased penetration into the formation. Another advantage of slanted cutters 1 is that they may be spaced more closely together than bent or angled cutters, thereby increasing the potential diamond volume of the bit. Therefore, the contact between the formation and bit blade 6 is decreased and the use of an increased number of cutters is permitted. Decreased contact between the formation and bit body results in increased durability of the bit, as there will be less abrasion of the bit body.

Figure 7:
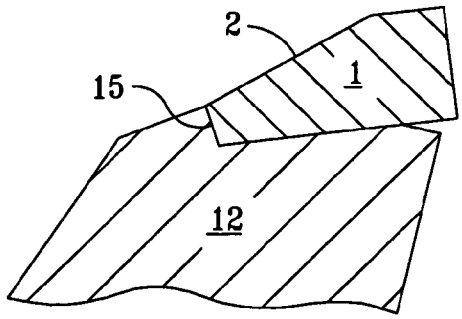
FIG. 7 shows an aggressively back-raked bit blade having slanted cutters in accordance with an embodiment of the present invention.
Figure 8:
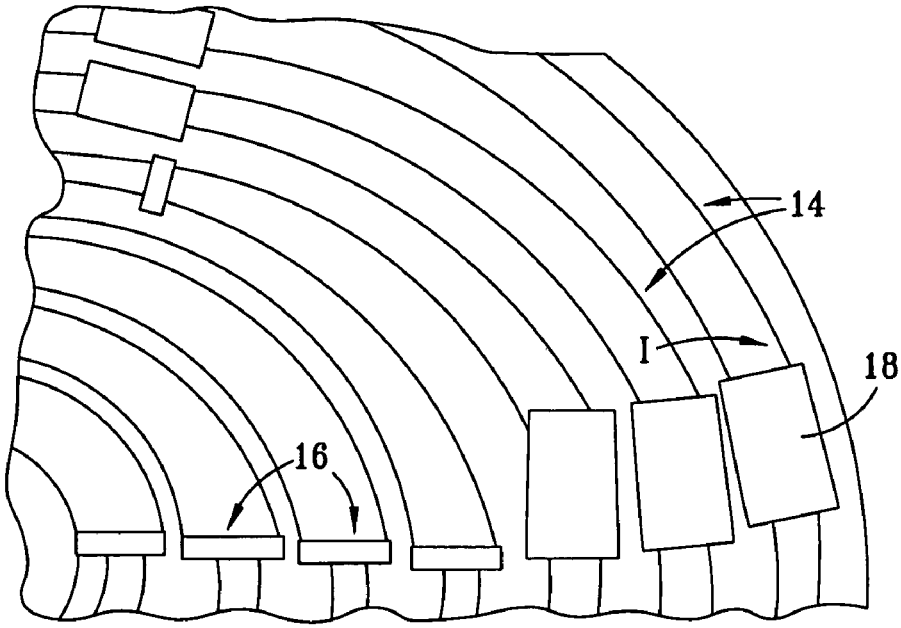
FIG. 8 is a schematic view drawing showing cutter interference in a borehole bottom.

Referring to FIG. 7, slanted cutters 1 allow for increased clearances between the cutter body and formation in aggressively back-raked bit blades 12 as well. Furthermore, as shown in the bottom-hole pattern of FIG. 8, traditional cylindrical cutters (shown schematically as 18) can undesirably interfere (shown at I) with circumferential grooves 14 cut into the hole bottom by the cutter faces. This interference I is primarily due to the increased off-angle contact of traditional cutters 18 with formation along the trailing length of the cutter behind the diamond cutting face. Because slanted cutters 1 have a reduced contact length with the hole bottom, they are less likely to interfere with circumferential grooves 14. The relatively small area along the top of slant cutters (shown schematically as 16) enables them to track the grooves 14 with significantly less interference I than traditional cylindrical cutters 18.

Figure 9:
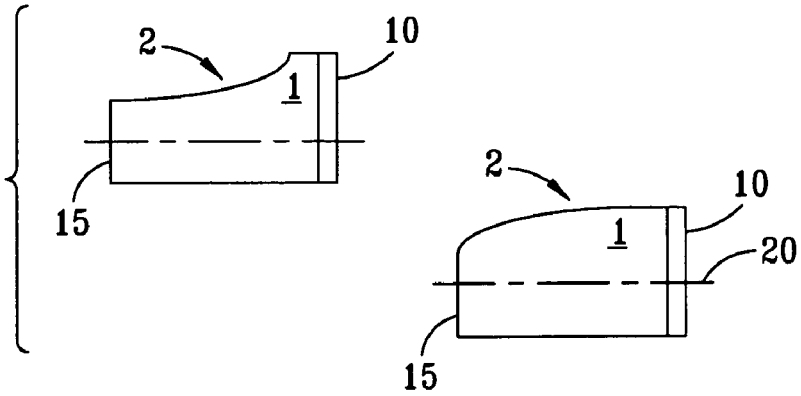
FIG. 9 shows alternative configurations for slanted cutters, in accordance with embodiments of the present invention.
Figure 10:
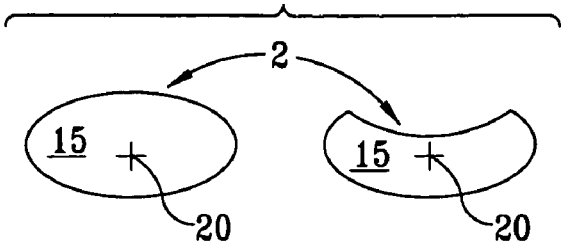
FIG. 10 shows alternative configurations of slanted cutters, in accordance with embodiments of the present invention.

While the slanted top profile 2 of cutter 1 shown in FIGS. 1-7 have a substantially linear profile when viewed from the side (FIG. 7), it should be understood by one of one of ordinary skill in the art that a slant cutter 1 in accordance with embodiments of the present invention can have different configurations for slanted top 2. Particularly, in reference to FIG. 9, slanted top profile 2 may be a generally convex or concave surface along a longitudinal axis 20 extending from cutter face 10 to back end 15. Furthermore, FIG. 10 shows that the slanted top profile 2 may also be convex or concave across the longitudinal axis 20 of the slanted cutter 1 extending from cutter face 10 to back end 15.

Finally, because slanted cutters 1 have a bottom surface that is similar to that of traditional cylindrical cutters, and a back end (15 in FIG. 7) that is relatively flat, little modification from traditional receiving pocket creation techniques will be required to accommodate embodiments of this new design. Furthermore, traditional cylindrical pockets are known to allow an increased flexibility with regard to cutter spacing and increased braze strength, and, therefore, the relatively minor modifications made to these receiving pockets in order to accommodate embodiments of this new cutter design are not expected to negatively affect such spacing and brazing advantages. The relatively flat back end 15 of the slanted cutter embodiments disclosed herein is also advantageous over bullet-type cutter configurations when drilling soft formations as soft-formation bits typically have a shallower receiving pocket in order to maximize exposure E of the cutter. Additionally, the flat back end 15 allows for an increased braze strength to resist the push-out forces that may damage such high-exposure configurations.

In various applications, a mix of slanted cutters may be used with "standard" cutters. In addition, cutters of the present invention may include a "thermally stable" polycrystalline diamond layer. As used herein, the term thermally stable refers to cutters that have been partially or completely leached. Absent leaching, impurities or thermally dissimilar components in the cutting surfaces can result in cutter fractures resulting from thermal strains.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

We claim:

1. A cutter for use with a drill bit, comprising:

a generally cylindrical cutter body extending from a substantially circular front face to a back end;

the front face comprising a superhard substance;

a longitudinal axis extending through the cutter body between the front face and the back end;

a top surface and a bottom surface extending between the back end and the front face of the generally cylindrical cutter body;

the back end and the bottom surface configured to be mounted in a receiving pocket of a drill bit body; and the top surface comprising a slant, wherein the slant extends beginning at the back end and ending at a location on the top surface between the back end and the front face;

wherein the slant is configured such that the front face protrudes from The receiving pocket farther than the back end; and wherein said slant is curved along said longitudinal axis.

2. The cutter according to claim 1, wherein the top surface further comprises an area that is substantially perpendicular to the front face.

3. The cutter according to claim 1, wherein the slant is concave along the longitudinal axis of the cutter.

4. The cutter according to claim 1, wherein the slant is convex along the longitudinal axis of the cutter.

5. The cutter according to claim 1, wherein the slant is concave across the longitudinal axis of the cutter.

6. The cutter according to claim 1, wherein the slant is convex across the longitudinal axis of the cutter.

7. The cutter according to claim 1 wherein the superhard substance is polycrystalline diamond.

8. The cutter according to claim 7 wherein the polycrystalline diamond is thermally stable.

9. The cutter according to claim 1 wherein the superhard substance is tungsten carbide.

10. A drill bit, comprising:

a bit body having at least one blade;

at least one generally cylindrical cutter mounted on the at least one blade, wherein the cutter comprises a substantially circular front face comprising a superhard surface, a back end, and a top surface comprising a slant extending beginning at the back end and extending to a location on the top surface between the back end and the front face; and a longitudinal axis extending through the cutter between the front face and the back end, wherein the slant is curved along the longitudinal axis and is configured such that the front face protrudes from a receiving pocket of the at least one blade farther than the back end.

11. The drill bit according to claim 10, wherein the top surface further comprises a region that is substantially perpendicular to the front face.

12. The drill bit according to claim 10, wherein the slant consists of one selected from a convex surface and a concave surface, along the longitudinal axis of the cutter.

13. The drill bit according to claim 10, wherein the slant consists of one selected from a convex surface and a concave surface, across the longitudinal axis of the cutter.

14. A cutter element to be used within a drill bit, the cutter element comprising:

a substantially circular hardened cutter face;

a back end;

a generally cylindrical cutter body extending from said cutter face to said back end, said cutter body defining a longitudinal axis;

said back end and a bottom portion of said cutter body configured to be received and secured within a receiving pocket of the drill bit;

a slanted profile beginning at said back end and extending to a location on the a top surface through said cutter body along said longitudinal axis to a location behind an upper portion of said hardened cutter face; and said slanted profile configured such that said upper portion of said hardened cutter protrudes from said receiving pocket farther than said back end;

wherein said slanted profile is curved along said longitudinal axis.

15. The cutter element of claim 14 wherein said slanted profile is concave along said longitudinal axis.

16. The cutter element of claim 14 wherein said slanted profile is convex along said longitudinal axis.

17. The cutter element of claim 14 wherein said slanted profile is curved across said longitudinal axis.

18. The cutter element of claim 17 wherein said slanted profile is concave across said longitudinal axis.

19. The cutter element of claim 17 wherein said slanted profile is convex across said longitudinal axis.

20. The cutter element of claim 14 wherein the hardened cutter face includes polycrystalline diamond.

21. The cutter element of claim 20 wherein the polycrystalline diamond is thermally stable.

22. The cutter element of claim 14 wherein the hardened cutter face includes tungsten carbide.

* * * * *